US007758967B2

(12) United States Patent
Suzuki

(10) Patent No.: US 7,758,967 B2
(45) Date of Patent: Jul. 20, 2010

(54) ANTIRUST TREATMENT METHOD FOR AN ALUMINUM DIE-CAST PART FOR VEHICULAR LIGHTING FIXTURE, AND AN ALUMINUM DIE-CAST PART FOR VEHICULAR LIGHTING FIXTURE

(75) Inventor: Akira Suzuki, Meguro-ku (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 12/110,091

(22) Filed: Apr. 25, 2008

(65) Prior Publication Data

US 2008/0271820 A1 Nov. 6, 2008

(30) Foreign Application Priority Data

Apr. 27, 2007 (JP) ..... 2007-119263

(51) Int. Cl.
*C23C 22/56* (2006.01)
*C23C 22/05* (2006.01)

(52) U.S. Cl. ..... 428/446; 428/469; 428/621; 428/651; 148/275

(58) Field of Classification Search ..... None
See application file for complete search history.

(56) References Cited

U.S. PATENT DOCUMENTS 4,976,918 A * 12/1990 Nishi et al. ..... 420/546
5,728,233 A 3/1998 Ikeda et al.
2005/0194574 A1* 9/2005 Yamamuro et al. ..... 252/500
2006/0037866 A1* 2/2006 Yamamoto et al. ..... 205/324
2006/0056003 A1* 3/2006 Tonar et al. ..... 359/265
2006/0213634 A1* 9/2006 Kaba et al. ..... 164/312
2006/0245025 A1* 11/2006 Tonar et al. ..... 359/265
2006/0245026 A1* 11/2006 Tonar et al. ..... 359/265
2007/0041197 A1* 2/2007 Saito et al. ..... 362/296
2007/0089808 A1 4/2007 Hashimoto

FOREIGN PATENT DOCUMENTS

EP 0 774 535 B1 5/1997
EP 1 693 485 A1 8/2006
JP 3437023 B2 6/2003
JP 2005-171296 A 6/2005
KR 1020060086441 A 7/2006
WO WO-2005/056876 A1 6/2005

* cited by examiner

*Primary Examiner*—Jennifer C McNeil
*Assistant Examiner*—Vera Katz
(74) *Attorney, Agent, or Firm*—Birch, Stewart, Kolasch & Birch, LLP

(57) ABSTRACT

An aluminum alloy-made part for a vehicular lighting fixture cast by the die-casting method and containing at least silicon is heated, whereby the silicon in the surface layer of the aluminum alloy-made part for a vehicular lighting fixture is oxidized to form a silicon oxide layer. By the heating treatment, the aluminum alloy-made part can achieve an antirust effect.

4 Claims, 7 Drawing Sheets

(RELATED ART)

ANTIRUST TREATMENT METHOD FOR AN ALUMINUM DIE-CAST PART FOR VEHICULAR LIGHTING FIXTURE, AND AN ALUMINUM DIE-CAST PART FOR VEHICULAR LIGHTING FIXTURE

BACKGROUND OF THE INVENTION

1. Field of the Invention

The present invention relates to an antirust treatment method for an aluminum die-cast part, and an aluminum die-cast part for a vehicular lighting fixture. More particularly, it relates to a technique for performing an antirust treatment method for an aluminum die-cast part for a vehicular lighting fixture at a low cost without performing a chromate treatment or a zirconium treatment.

2. Description of the Related Art

Conventionally, from the viewpoint of heat resistance and light distribution control accuracy, an aluminum die-cast part has been used in a vehicular lighting fixture. One example of the aluminum die-cast part for a vehicular lighting fixture is a shade that is disposed in a projector type headlamp and has a reflective surface for controlling overhead light distribution illuminating traffic signs while forming a cutoff line for low beam.

FIG. 5 is a flowchart for explaining a general manufacturing process for a conventional shade.

As shown in FIG. 5, the conventional shade is manufactured through the following steps: a step of injection molding an aluminum alloy (an alloy for die-casting specified by JIS symbol ADC12) that contains silicon by using a die-casting machine (Step S100); a step of deburring (blasting etc.) the injection molded shade (Step S101); a step of degreasing the deburred shade with a detergent solvent to remove fats and oils (Step S102); a water washing step (Step S103); a step of applying an antirust treatment to the washed shade (chromate treatment (for example, Japanese Patent Application Laid-Open No. 2005-171296) or zirconium treatment (for example, Japanese Patent No. 3437023)) (Step S104); a water washing step (Step S105); a hot-water washing step (Step S106); a drying step (Step S107); and the like steps. Between the deburring step (Step S101) and the degreasing step (Step S102), a barrel polishing step (Step S108) is sometimes provided to increase the surface reflectance.

SUMMARY OF THE INVENTION

However, both of the chromate treatment and the zirconium treatment, each of which is an antirust treatment, are surface treatment using heavy metal salts and acids; therefore they require process control of immersion time, temperature, concentration, PH, and the like of chemicals, special treatment equipments including a multistage water washing tank, and waste water treatment equipments for preventing pollution caused by heavy metal salts, acids, etc., which presents a problem of increased cost.

The present invention has been made in view of the above circumstances, and aims to provide an antirust treatment method for an aluminum die-cast part for a vehicular lighting fixture performed at a low cost without performing a chromate treatment or a zirconium treatment.

To achieve the above object, according to a first aspect of the present invention, an antirust treatment method for an aluminum die-cast part for a vehicular lighting fixture, comprises heating the aluminum alloy-made part for a vehicular lighting fixture which is cast by the die-casting method and contains at least silicon, whereby the silicon in the surface layer of the aluminum alloy-made part is oxidized to form a silicon oxide layer.

In the antirust treatment method according to the first aspect of the present invention, merely by heating the aluminum alloy-made part for a vehicular lighting fixture which contains at least silicon, the silicon oxide layer which achieves an antirust effect is formed in the surface layer of the aluminum alloy-made part for a vehicular lighting fixture. Therefore, unlike the conventional example, the aluminum alloy-made part for a vehicular lighting fixture can be subjected to an antirust treatment without being subjected to a chromate treatment or a zirconium treatment.

In addition, merely by heating the aluminum alloy-made part for a vehicular lighting fixture which contains at least silicon, the reflectance of the aluminum alloy-made part can be improved as compared with the reflectance of a part for vehicular lighting fixture subjected to a chromate treatment or a zirconium treatment.

Further, according to the first aspect of the present invention, effects of reduced cost and prevention of environmental pollution can be achieved. That is to say, since, unlike the conventional example, neither the chromate treatment nor zirconium treatment is performed, unlike the chromate treatment and zirconium treatment, process control of immersion time, temperature, concentration, PH, and the like of chemicals, special treatment equipments including a multistage water washing tank, waste water treatment equipments for preventing pollution caused by heavy metal salts, acids and alkalis, and running cost necessary for these pieces of equipment are not needed.

According to a second aspect of the present invention, in the antirust treatment method according to the first aspect, the aluminum alloy-made part is heated at a temperature of 280° C. or higher for five hours or longer.

By the antirust treatment method according to the second aspect of the present invention, a silicon oxide layer having a thickness suitable for achieving the antirust effect can be formed.

According to a third aspect of the present invention, an aluminum die-cast part for a vehicular lighting fixture formed of an aluminum alloy containing at least silicon, comprising a silicon oxide layer formed in the surface layer of the aluminum die-cast part.

According to the third aspect of the present invention, since the silicon oxide layer which achieves an antirust effect is formed in the surface layer of the aluminum die-cast part for a vehicular lighting fixture, the aluminum die-cast part can achieve an antirust effect which is substantially equivalent to that of an aluminum die-cast part for a vehicular lighting fixture subjected to a chromate treatment or a zirconium treatment. In addition, a reflectance of the aluminum die-cast part for a vehicular lighting fixture can be improved as compared with a reflectance of an aluminum die-cast part for a vehicular lighting fixture subjected to a chromate treatment or a zirconium treatment.

According to a fourth aspect of the invention, in the aluminum die-cast part for a vehicular lighting fixture according to the third aspect, the aluminum alloy which contains silicon is an alloy for die-casting specified by JIS symbol ADC12.

"JIS symbol ADC12" is an exemplification of an aluminum alloy that contains silicon. The present invention is not limited to the alloy for die-casting of this type. For example, an alloy for die-casting specified by JIS symbol ADC10 may be used as the silicon-containing aluminum alloy.

According to a fifth aspect of the present invention, in the aluminum die-cast part for a vehicular lighting fixture according to the third or fourth aspect, the silicon oxide layer has a thickness of 10 Å or larger.

According to the fifth aspect of the present invention, the aluminum die-cast part with an antirust effect substantially equivalent to that of an aluminum die-cast part for a vehicular lighting fixture subjected to a chromate treatment or a zirconium treatment can be achieved.

According to the present invention, an aluminum die-cast part for a vehicular lighting fixture can be subjected to an antirust treatment at a low cost without being subjected to a chromate treatment or a zirconium treatment.

DETAILED DESCRIPTION OF THE PREFERRED EMBODIMENTS

Hereunder, an antirust treatment method for an aluminum die-cast part for a vehicular lighting fixture in accordance with one embodiment of the present invention is explained with reference to the accompanying drawings. In this description, the aluminum die-cast part for a vehicular lighting fixture is explained by taking a shade 10 shown in FIG. 1 as an example.

Figure 1:
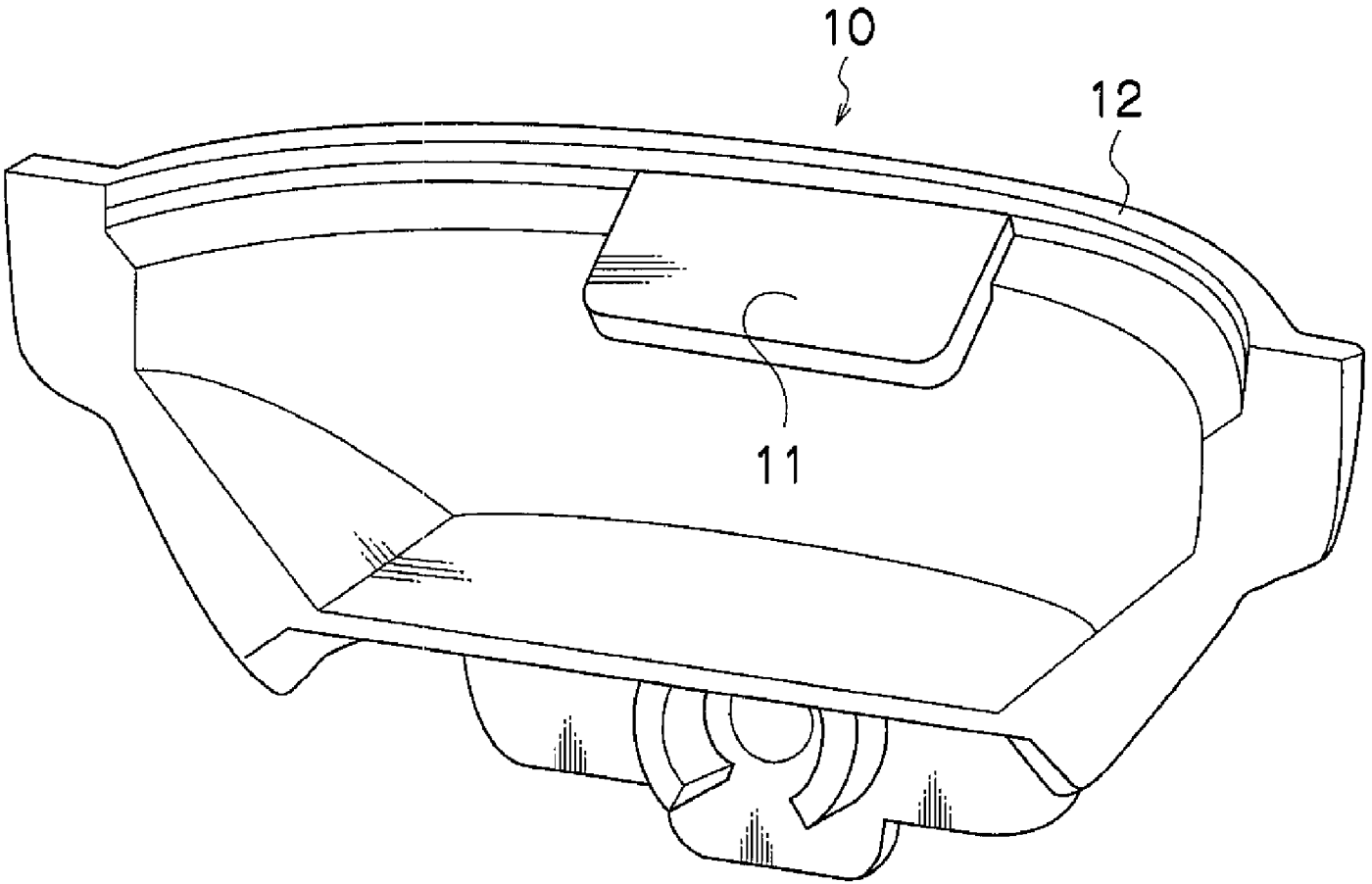
FIG. 1 is a perspective view of a shade to which antirust treatment is applied by an antirust treatment method in accordance with one embodiment of the present invention.
Figure 2:
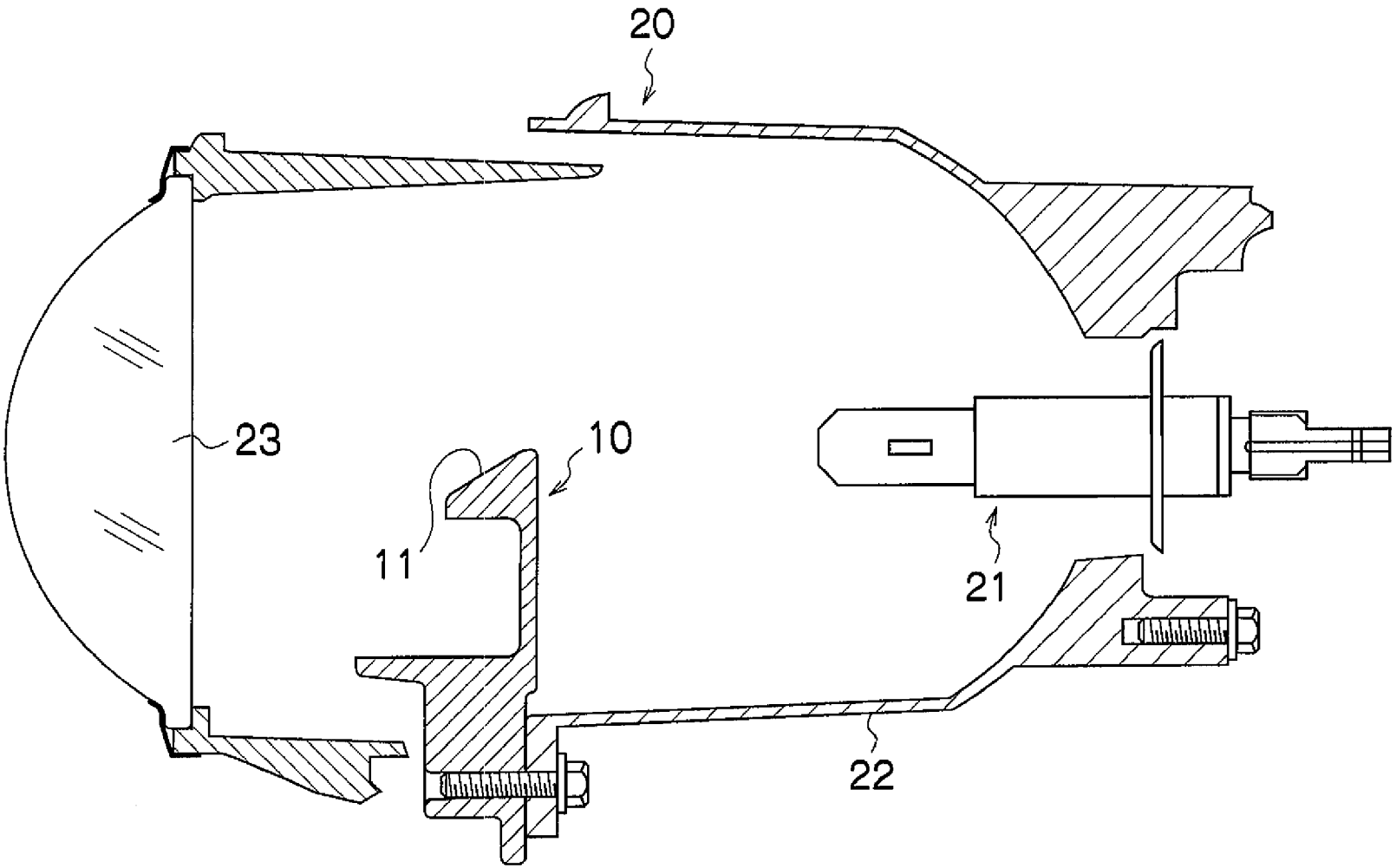
FIG. 2 is a partial sectional view of a headlamp in which the shade shown in FIG. 1 is disposed.

FIG. 1 is a perspective view of a shade 10 to which an antirust treatment is applied by an antirust treatment method in accordance with one embodiment of the present invention. FIG. 2 shows an example of a headlamp 20 in which the shade 10 shown in FIG. 1 is disposed.

As shown in FIG. 2, the shade 10 is a part that is disposed in the projector type headlamp 20 and is used to form a cutoff line for low beam on a top end face 12. The shade 10 is provided with a reflective plate 11 for controlling overhead light distribution illuminating traffic signs. The headlamp 20 is also provided with a light source 21 such as an incandescent lamp, an HID lamp (HID: High Intensity Discharge) or an LED lamp (LED: Light Emitting Diode), a reflector 22 functioning as a reflective surface, a lens 23, and the like.

This shade 10 is manufactured as described below.

Figure 3:
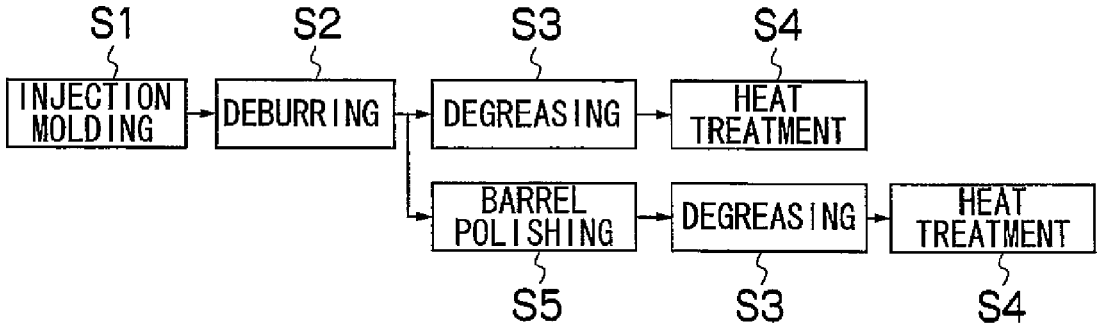
FIG. 3 is a flowchart for explaining a manufacturing process for an aluminum die-cast vehicular lighting fixture part.

FIG. 3 is a flowchart for explaining a manufacturing process for the shade 10.

As shown in FIG. 3, the shade 10 is manufactured through the following steps: a step of injection molding an aluminum alloy (in this embodiment, an alloy for die-casting specified by JIS symbol ADC12) that contains silicon by using a die-casting machine (Step S1); a step of deburring (blasting etc.) the injection molded shade 10 (Step S2); a step of degreasing the deburred shade 10 with a detergent solvent to remove fats and oils (Step S3); a step of applying an antirust treatment (heat treatment) to the degreased shade 10 (Step S4). In addition, between the deburring step (Step S2) and the degreasing step (Step S3), a barrel polishing step (Step S5) is sometimes provided to increase the surface reflectance. Further, the degreasing step (Step S3) is not an essential step, and is provided as necessary. The chemical composition of the die-casting alloy (JIS symbol ADC12) is, for example, 1.5 to 3.5% Cu, 9.6 to 12.0% Si, 0.3% or less Mg, 1.0% or less Zn, 1.3% or less Fe, 0.5% or less Mn, 0.5% or less Ni, 0.2% or less Sn, balance Al.

Next, the step of performing an antirust treatment (heat treatment) (Step S4) is explained.

In the step of performing an antirust treatment (heat treatment) (Step S4), the whole of the shade 10 is heated by using, for example, a general drying furnace (thermostatic chamber) (heated preferably at 280° C. for five hours, further preferably at 280° C. for twenty-four hours, still further preferably at 280° C. or higher for twenty-four hours or longer).

The inventor of the present invention conducted an elemental analysis in the depth direction by using X-ray photoelectron spectroscopy (XPS) on the surface of the shades 10 to which the above-mentioned antirust treatment (heat treatment) are applied.

Figure 4A:
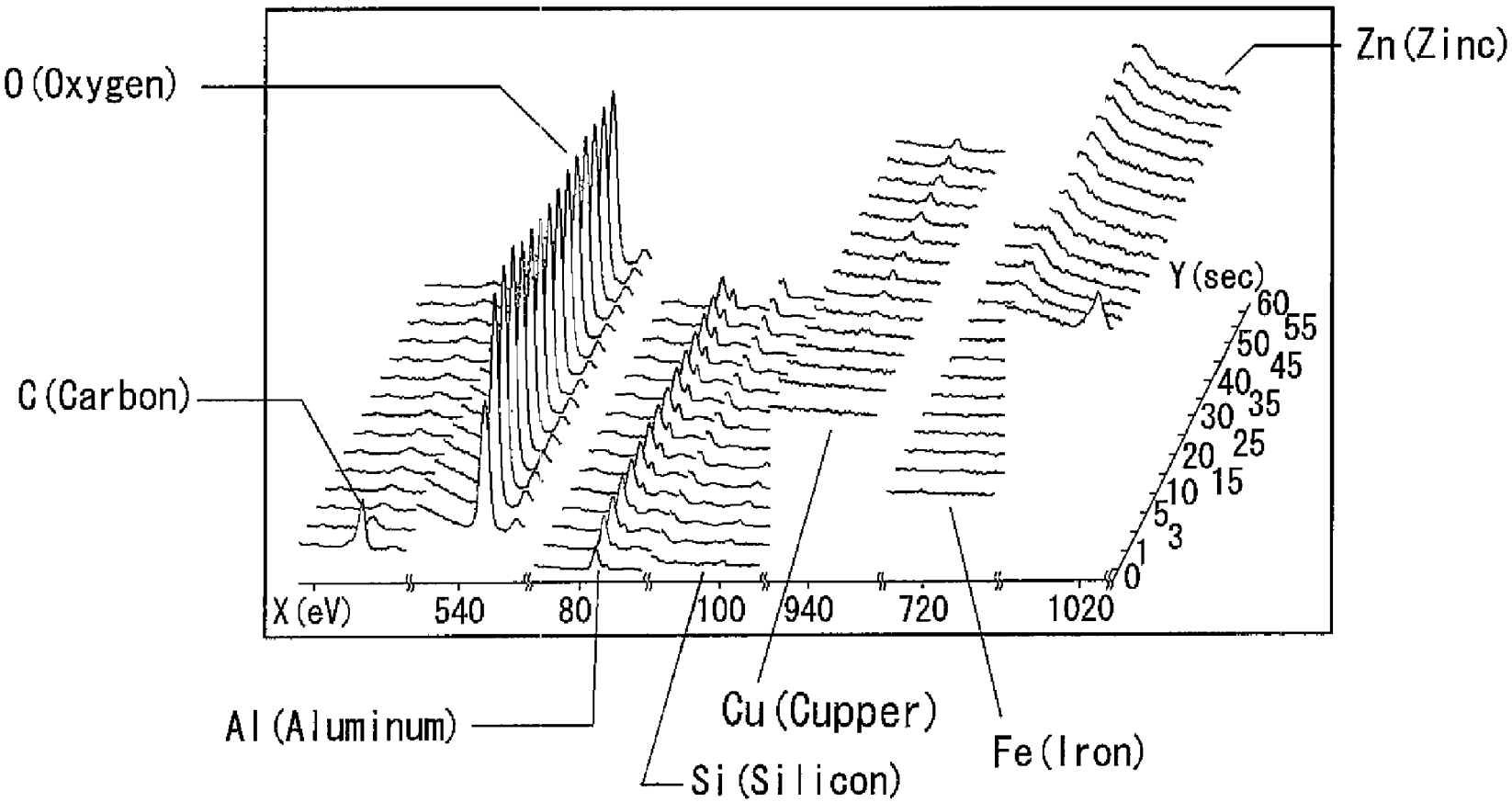
FIGS. 4A to 4C are charts showing results of elemental analysis conducted in the depth direction by using XPS on the surfaces of shades heated under different conditions and a shade without heating.
Figure 4B:
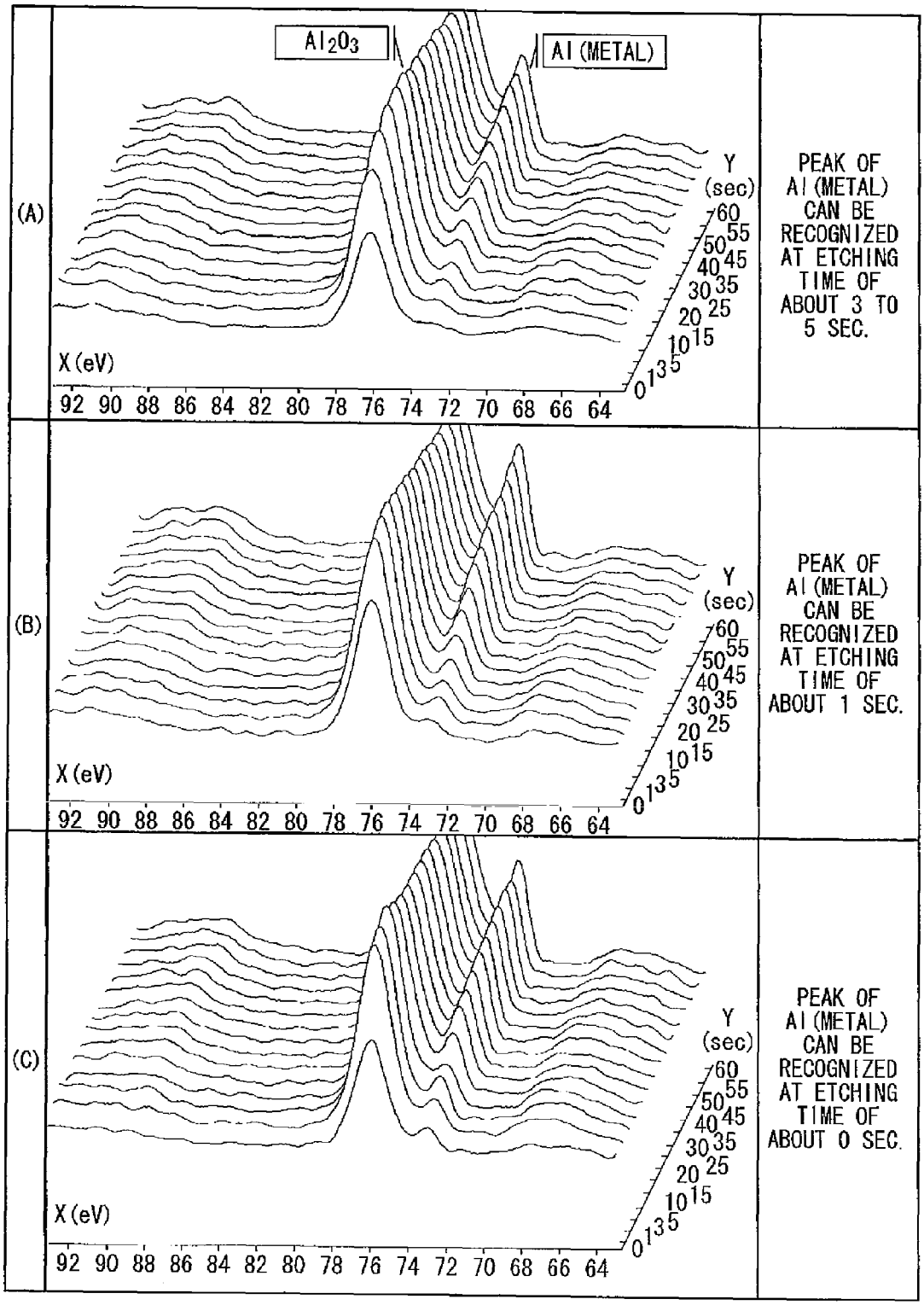
Figure 4C:
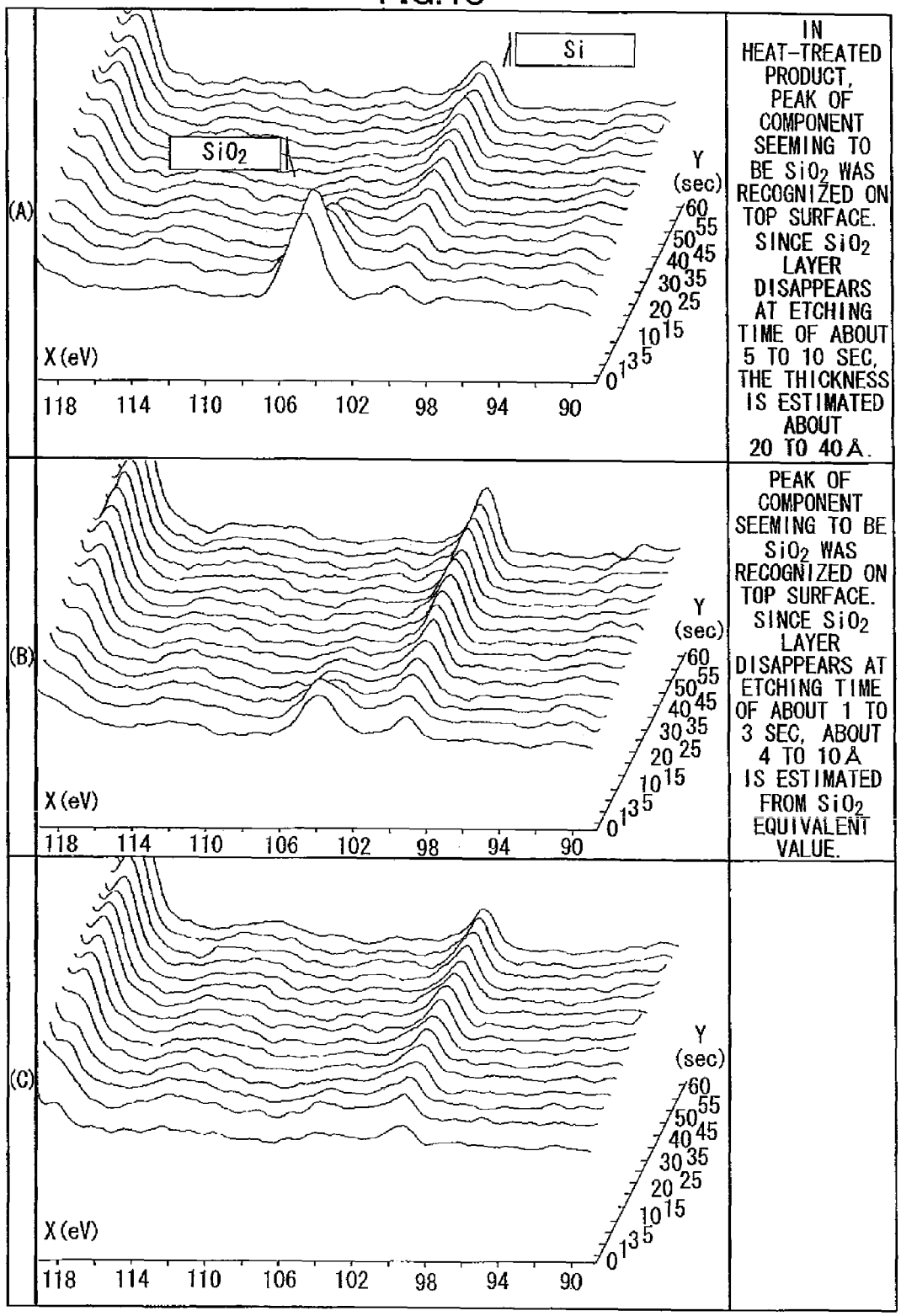
Figure 5:
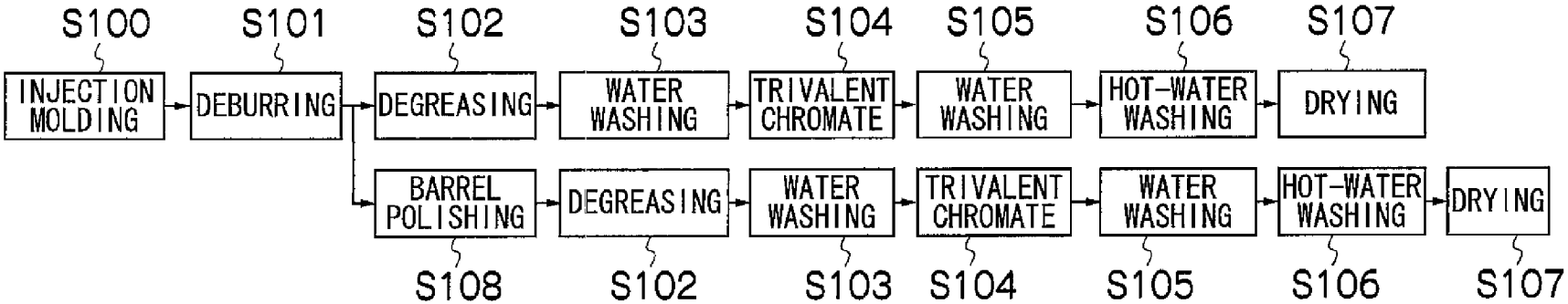
FIG. 5 is a flowchart for explaining a manufacturing process for a conventional aluminum die-cast vehicular lighting fixture part.

As the result, it was confirmed that silicon and aluminum in the surface layer of each shade 10 to which the antirust treatment (heat treatment) is applied are oxidized to form a silicon oxide layer and an aluminum oxide layer (refer to FIGS. 4A to 4C and Table 1).

FIGS. 4A to 4C are charts showing results of elemental analysis conducted in the depth direction by using XPS on surfaces of shades 10 heated under the above-mentioned different conditions (280° C. for twenty-four hour heating and 280° C. for five hour heating) and a surface of a shade 10 not subjected to a heat treatment. In the XPS for the analysis, etching rate is 250 Å/min ($SiO_2$ equivalent). The charts show spectrums representing distribution of metal layers in the depth direction. In each chart, the x-axis indicates photoelectron energy, the y-axis indicates etching time (second) (corresponds to depth), and the vertical axis indicates intensity of photoelectron.

FIG. 4A shows distribution of each element on the surface of a shade 10 not subjected to a heat treatment. As shown in FIG. 4A, spectrums corresponding to each element are obtained. The spectrums represent Carbon, Oxygen, Aluminum (Al), Silicon (Si), Cupper, Iron, and Zinc, from the left end of the chart, respectively. Charts for surfaces of shades 10 subjected to a heat treatment are omitted.

FIG. 4B shows enlarged spectrums of aluminum oxide ($Al_2O_3$) and aluminum (Al). In FIG. 4B, the portion (A) shows spectrums of aluminum oxide ($Al_2O_3$) and Al (metal) when a shade 10 is subjected to a heat treatment at 280° C. for twenty-four hours, the portion (B) shows those when a shades 10 is subjected to a heat treatment at 280° C. for five hours, the portion (C) shows those when a shade 10 is not applied a heat treatment. In the portion (A) of FIG. 4B, a peak of Al (metal) spectrum can be recognized at etching time of about 3 to 5 sec. In the portion (B) of FIG. 4B, a peak of Al (metal) spectrum can be recognized at etching time of about 1 sec. In the portion (C) of FIG. 4B, a peak of Al (metal) spectrum can be recognized at etching time of 0 (zero) sec.

FIG. 4C shows enlarged spectrums of silicon oxide ($SiO_2$) and silicon (Si). In FIG. 4C, the portion (A) shows spectrums of silicon oxide ($SiO_2$) and Si when a shade 10 is subjected to the heat treatment at 280° C. for twenty-four hours, the portion (B) shows those when a shade 10 is subjected to the heat treatment at 280° C. for five hours, the portion (C) shows those when a shade 10 is not applied a heat treatment. In the portion (A) of FIG. 4C, a peak of a spectrum of a component seeming to be $SiO_2$ is recognized on the top surface. Since the peak of $SiO_2$ spectrum disappears at etching time of about 5 to 10 sec, the thickness of the $SiO_2$ layer is estimated to be about 20 to 40 Å on the basis of $SiO_2$ equivalent value. In the portion (B) of FIG. 4C, a peak of a spectrum of a component seeming to be $SiO_2$ is recognized on the top surface just as the portion (A). Since the peak of $SiO_2$ spectrum disappears at etching time of about 1 to 3 sec, the thickness of the $SiO_2$ layer is estimated to be about 4 to 10 Å on the basis of $SiO_2$ equivalent value. In the portion (C), on the contrary, no peak of $SiO_2$ spectrum can be recognized.

TABLE 1

| | 280° C. for 24 hr heating | 280° C. for 5 hr heating | No heat treatment |
|---|---|---|---|
| $SiO_2$ layer | Thickness of 20 to 40 Å from top surface | Thickness of 4 to 10 Å from top surface | Peak of $SiO_2$ scarcely recognized on top surface |
| $Al_2O_3$ layer | Thickness of 10 to 20 Å from top surface | Thickness of 4 Å from top surface | Al metal recognized on top surface |

Table 1 summarizes the results of element analysis. According to Table 1, it can be confirmed that the thicknesses of the silicon oxide layer and the aluminum oxide layer of the shade 10 become larger when the shade 10 is heated for a longer period of time (in the above-described example, the thickness after twenty-four-hour heating becomes larger than the thickness after five-hour heating) as the antirust treatment.

Also, as the results of measurement, comparison, analysis, and the like, described later, (example 1 to 3), the inventor of the present invention confirmed that the shade 10 formed with the silicon oxide layer and the aluminum oxide layer achieves an antirust effect (hereinafter referred also to as corrosion resistance) substantially equivalent to that of a shade 10 subjected to a chromate treatment or a zirconium treatment (refer to Table 3).

Also, it was confirmed that a reflectance of a reflective plate 11 of the shade 10 formed with the silicon oxide layer and the aluminum oxide layer was improved as compared with a reflectance of a reflective plate 11 of the shade 10 subjected to a chromate treatment or a zirconium treatment (refer to Tables 2 and 4).

As explained above, according to this embodiment, in the step of performing an antirust treatment (heat treatment) (Step S4), the shade 10 is heated (heated preferably at 280° C. for five hours, further preferably at 280° C. for twenty-four hours, or still further preferably at 280° C. or higher for twenty-four hours or longer), whereby the silicon oxide layer and the aluminum oxide layer are formed in the top surface layer of the shade 10. Therefore, the shade 10 can be subjected to an antirust treatment without performing a chromate treatment or a zirconium treatment as in the conventional example.

Also, according to this embodiment, in the step of performing an antirust treatment (heat treatment) (Step S4), the shade 10 is heated (heated preferably at 280° C. for five hours, further preferably at 280° C. for twenty-four hours, or still further preferably at 280° C. or higher for twenty-four hours or longer), whereby the reflectance of the reflective plate 11 of the shade 10 can be improved as compared with the reflectance of the reflective plate 11 of the shade 10 subjected to the chromate treatment or the zirconium treatment.

Further, according to this embodiment, since chromate treatment or zirconium treatment is not performed unlike the conventional example, effects of reduced cost and prevention of environmental pollution can be achieved. That is to say, unlike the chromate treatment and zirconium treatment, process control of immersion time, temperature, concentration, PH, and the like of chemicals, special treatment equipments including a multistage water washing tank, waste water treatment equipments for preventing pollution caused by heavy metal salts, acids, and alkalis, and running cost necessary for these pieces of equipment are not needed. In addition, according to this embodiment, an antirust treatment can be performed by using a general drying furnace (thermostatic chamber) having a temperature lower than 300° C.

Next, a modification is explained.

In this embodiment, the aluminum die-cast part for a vehicular lighting fixture has been explained by taking the shade 10 shown in FIG. 1 as an example. However, the present invention is not limited to the vehicular lighting fixture part. Any other part may be used as the aluminum die-cast part.

In addition, in this embodiment, the silicon-containing aluminum alloy has been explained by taking the alloy for die-casting specified by JIS symbol ADC12 as an example. However, the present invention is not limited to the alloy for die-casting of this type. For example, an alloy for die-casting specified by JIS symbol ADC10 may be used as the silicon-containing aluminum alloy.

In addition, in this embodiment, as the preferable conditions of antirust treatment for achieving the antirust effect, only 280° C. for twenty-four hours and 280° C. for five hours have been described specifically. However, only these two conditions have been described specifically for the reason of time restriction, and therefore the present invention is not limited to these two conditions. As is apparent from Table 5, as the preferable condition of the antirust treatment for achieving the antirust effect, a condition of higher temperature (280° C. or higher) and a longer period of time (preferably five hours or longer, further preferably twenty-four hours or longer) can be adopted. Under this condition as well, the achievement of an antirust effect substantially equivalent to or greater than that of a chromate treatment or a zirconium treatment can be expected.

Next, examples of an antirust treatment (heat treatment) performed on the shade 10 are explained specifically.

Example 1

In example 1, four shades 10 deburred by using #1500-grit sandpaper after being injection molded were used. In example 1, as an antirust treatment (heat treatment), the whole of one shade 10 was heated by using a general drying furnace (thermostatic chamber) (heated at 280° C. for twenty-four hours). For comparison of performance, two shades 10 were subjected to a trivalent chromate treatment (ALT 610 manufactured by Dipsol Chemicals Co., Ltd. was used) and a zirconium treatment (ALSURF 315 manufactured by Nippon Paint Co., Ltd. was used), respectively. The remaining one shade 10 was untreated (not subjected to any of a heat treatment, a trivalent chromate treatment, and a zirconium treatment).

The surface (of the reflective plate 11) of the shade 10 subjected to the antirust treatment (formed with the silicon oxide layer and the aluminum oxide layer), the surface (of the reflective plate 11) of the shade 10 subjected to the trivalent chromate treatment, the surface (of the reflective plate 11) of the shade 10 subjected to the zirconium treatment, and the surface (of the reflective plate 11) of the untreated shade 10 were measured by using a reflectometer (TR-1100AD (Tokyo Denshoku Co., Ltd.), angle of incidence 45°).

The result of this measurement (comparative example) is as given in Table 2.

TABLE 2

| Item | Heat treatment | Untreated | Trivalent chromate treatment | Zirconium treatment |
|---|---|---|---|---|
| Total reflectivity (%) | 51.2 | 48.4 | 33.8 | 38.4 |

According to Table 2, it can be confirmed that a reflectivity of a reflective plate 11 of the shade 10 subjected to the antirust treatment (heat treatment) (formed with the silicon oxide layer and the aluminum oxide layer) is improved as compared with a reflectivity of a reflective plate 11 of the shade 10 subjected to the trivalent chromate treatment or the zirconium treatment. In addition, the reflectivity of the surface of the shade 10 subjected to the trivalent chromate treatment or the zirconium treatment is 10 to 15% lower than the reflectivity of the surface of the untreated shade 10. However, the reflectivity of the surface of the shade 10 subjected to the antirust treatment (heat treatment) of example 1 does not decrease as compared with the reflectivity of the surface of the untreated shade 10, and is rather improved by 2 to 3%.

To determine the cause for improvement in reflectivity, the inventor of the present invention observed the surfaces of the shades 10 heated under different conditions (280° C. for twenty-four-hour heating, 280° C. for five-hour heating) and the surface of the untreated shade 10 by using an electron microscope.

As the result, it was confirmed that each of the heated shades 10 has denser surface (smooth surface with less bumps and dents) than the untreated shade 10. In addition, it was confirmed that the shade 10 heated at 280° C. for twenty-four hours has a denser surface (smooth surface with less bumps and dents) than the shade 10 heated at 280° C. for five hours.

From the above observation results, it is thought that the change of the surface of the heated shades 10 to a denser surface contributes to the improvement in reflectivity.

Next, the surface of the shade 10 subjected to the antirust treatment (formed with the silicon oxide layer and the aluminum oxide layer), the surface of the shade 10 subjected to the chromate treatment, the surface of the shade 10 subjected to the zirconium treatment, and the surface of the untreated shade 10 were subjected to a neutral salt spray test (for forty-eight hours) specified in JIS H 8502 (JIS: Japanese Industrial Standard, and "H 8502" corresponds to an anticorrosion test for coating) to measure the white rust area ratio.

The result of this measurement (comparative example) is as given in Table 3.

TABLE 3

| Item | Heat treatment | Untreated | Trivalent chromate treatment | Zirconium treatment |
|---|---|---|---|---|
| White rust area ratio (%) | 0.5 | 70.0 | 0.2 | 0.5 |
| Rating number | 7 | 0 | 8 | 7 |

According to Table 3, it can be confirmed that the shade 10 subjected to the antirust treatment (heat treatment) (formed with the silicon oxide layer and the aluminum oxide layer) achieves an antirust effect about equivalent to that of the shade 10 subjected to the trivalent chromate treatment or the zirconium treatment.

Example 2

In example 2, four shades 10 deburred by zinc shotblasting after being injection molded were used. In example 2, as an antirust treatment, the whole of one shade 10 was heated by using a general drying furnace (thermostatic chamber) (heated at 280° C. for twenty-four hours). For comparison of performance, two shades were subjected to the trivalent chromate treatment (ALT 610 manufactured by Dipsol Chemicals Co., Ltd. was used) and the zirconium treatment (ALSURF 315 manufactured by Nippon Paint Co., Ltd. was used), respectively. The remaining one shade 10 was untreated (not subjected to any of the heat treatment, the trivalent chromate treatment, and the zirconium treatment).

The surface (of the reflective plate 11) of the shade 10 subjected to the antirust treatment (formed with the silicon oxide layer and the aluminum oxide layer), the surface (of the reflective plate 11) of the shade 10 subjected to the chromate treatment, the surface (of the reflective plate 11) of the shade 10 subjected to the zirconium treatment, and the surface of the untreated shade 10 were measured by using a reflectometer (TR-1100AD (Tokyo Denshoku Co., Ltd.), angle of incidence 45°).

The result of this measurement (comparative example) is as given in Table 4.

TABLE 4

| Item | Heat treatment | Untreated | Trivalent chromate treatment | Zirconium treatment |
|---|---|---|---|---|
| Total reflectivity (%) | 38.1 | 34.4 | 24.9 | 28.4 |

According to Table 4, even in the case where the shades 10 were deburred by zinc shotblasting, it can be confirmed that, as in example 1, a reflectivity of a reflective plate 11 of the shade 10 subjected to the antirust treatment (heat treatment) (formed with the silicon oxide layer and the aluminum oxide layer) is improved as compared with a reflectivity of a reflective plate 11 of the shade 10 subjected to the chromate treatment or the zirconium treatment. In addition, the reflectivity of the surface of the shade 10 subjected to the trivalent chromate treatment or the zirconium treatment is 10 to 15% lower than the reflectivity of the surface of the untreated shade 10. However, the reflectivity of the surface of the shade 10 subjected to the antirust treatment (heat treatment) of Example 2 does not decrease as compared with the reflectivity of the surface of the untreated shade 10, and is rather improved by 2 to 3%.

To determine the cause for improvement in reflectivity, the inventor of the present invention observed the surfaces of the shades 10 heated under different conditions (280° C. for twenty-four-hour heating, 280° C. for five-hour heating) and the surface of the untreated shade 10 by using an electron microscope.

As the result, it was confirmed that each of the heated shades 10 has denser surface (smooth surface with less bumps and dents) than the untreated shade 10. In addition, it was confirmed that the shade 10 heated at 280° C. for twenty-four hours has a denser surface (smooth surface with less bumps and dents) than the shade 10 heated at 280° C. for five hours.

From the above observation results, it is thought that the change of the surface of the heated shades 10 to a denser surface contributes to the improvement in reflectivity.

Next, the surface of the shade 10 subjected to the antirust treatment (formed with the silicon oxide layer and the aluminum oxide layer), the surface of the shade 10 subjected to the chromate treatment, the surface of the shade 10 subjected to the zirconium treatment, and the surface of the untreated shade 10 were subjected to the neutral salt spray test (for forty-eight hours) specified in JIS H8502 to measure the white rust area ratio.

The result of this measurement (comparative example) was the same as that given in Table 3 (the table of the result is omitted).

Example 3

In example 3, four shades 10 deburred by using #1500-grit sandpaper after being injection molded were used. In example 3, as an antirust treatment (heat treatment), the whole of each of three shades 10 was heated by using a general drying furnace (thermostatic chamber) under different conditions (heated at 280° C. for twenty-four hours, at 280° C. for five hours, and at 180° C. for twenty-four hours). For comparison of performance, the remaining one shade 10 was untreated (not subjected to a heat treatment in this example).

The surfaces of the three shades 10 subjected to the antirust treatment (formed with the silicon oxide layer and the aluminum oxide layer), and the surface of the untreated shade 10 were subjected to the neutral salt spray test (for forty-eight hours) specified in JIS H8502 to measure the white rust area ratio.

The result of this measurement (comparative example) is as given in Table 5.

TABLE 5

| Item | 280° C. × 24 H | 280° C. × 5 H | 180° C. × 24 H | Untreated |
|---|---|---|---|---|
| White rust area ratio (%) | 0.5 | 20.0 | 50.0 | 70.0 |
| Rating number | 7 | 2 | 1 | 0 |

According to Table 5, it can be understood that when the shade 10 is heated at a higher temperature (280° C. or higher) for a longer period of time (preferably five hours or longer, further preferably twenty-four hours or longer) as an antirust treatment, the achievement of an antirust effect substantially equivalent to or greater than that achieved by a chromate treatment or a zirconium treatment can be expected.

In addition, according to Table 5, it can be confirmed that the heating at 280° C. for twenty-four hours improves the antirust effect than the heating at 280° C. for five hours. The main reason for this is that the thickness (20 to 40 Å) of the silicon oxide layer formed by the heating at 280° C. for twenty-four hours is larger than the thickness (4 to 10 Å) of the silicon oxide layer formed by the heating at 280° C. for five hours (refer to Table 1). Alternatively, it can be thought that the fact that the thickness (10 to 20 Å) of the aluminum oxide layer formed by the heating at 280° C. for twenty-four hours is larger than the thickness (4 Å) of the aluminum oxide layer formed by the heating at 280° C. for five hours also has an effect. Alternatively, it can be thought that the fact that the surface of the heat-treated shade 10 after the twenty-four-hour heating changes to a denser surface than that after the five-hour heating also has an effect.

The above-described embodiment is merely an example in all respects. The present invention is not construed limitedly by the description of the above-described embodiment. The present invention can be carried out in other various modes without departing from the spirit and principal features thereof.

What is claimed is:

1. An aluminum die-cast part for a vehicular lighting fixture formed of an aluminum alloy containing at least silicon, comprising a silicon oxide layer formed in the surface layer of the aluminum die-cast part, wherein the silicon oxide layer is formed in the surface layer of the aluminum die-cast part by applying a heat treatment, and the silicon oxide layer has a thickness of 4 Å to 40 Å, and wherein the heat treatment comprises heating at a temperature of 280° C. or higher for five hours or longer and results in oxidation of the aluminum and the silicon in the aluminum alloy.

2. The aluminum die-cast part for a vehicular lighting fixture according to claim 1, wherein the heat treatment comprises heating at a temperature of 280° C. for twenty four hours or longer.

3. The aluminum die-cast part for a vehicular lighting fixture according to claim 1, wherein the heat treatment comprises heating at a temperature of 280° C. for five hours or longer.

4. An aluminum die-cast part for a vehicular lighting fixture formed of an aluminum alloy containing at least silicon, comprising a silicon oxide layer formed in the surface layer of the aluminum die-cast part, wherein the silicon oxide layer is formed in the surface layer of the aluminum die-cast part by applying a heat treatment, and the silicon oxide layer has a thickness of 4 Å to 40 Å, and wherein the heat treatment comprises heating at a temperature of 180° C. or higher for twenty four hours or longer and results in oxidation of the aluminum and the silicon in the aluminum alloy.

* * * * *